US005795463A

United States Patent [19]

Prokopowicz

[11] Patent Number: 5,795,463

[45] Date of Patent: Aug. 18, 1998

[54] OIL DEMETALIZING PROCESS

[76] Inventor: Richard A. Prokopowicz, 2018 45 Carlton St., Toronto, Ont., Canada, M5B2H9

[21] Appl. No.: 691,825

[22] Filed: Aug. 5, 1996

[51] Int. Cl.[6] ..... C10G 17/00

[52] U.S. Cl. ..... 208/251 R; 208/252; 208/180; 208/253

[58] Field of Search ..... 208/252, 180, 208/251 R

[56] References Cited

U.S. PATENT DOCUMENTS

| | | | |
|---|---|---|---|
| 3,305,478 | 2/1967 | Gilson et al. | 208/180 |
| 3,639,229 | 2/1972 | Brownawell et al. | 208/180 |
| 3,763,036 | 10/1973 | Jordan et al. | 208/180 |
| 3,874,282 | 4/1975 | Johnson | 208/180 |
| 3,930,988 | 1/1976 | Johnson | 208/182 |
| 3,985,642 | 10/1976 | Friel et al. | 208/180 |
| 4,073,720 | 2/1978 | Whisman et al. | 208/180 |
| 4,151,072 | 4/1979 | Nowack | 208/180 |
| 4,408,894 | 10/1983 | Nadkarni et al. | 208/252 |
| 4,411,774 | 10/1983 | Johnson | 208/252 |
| 4,432,865 | 2/1984 | Norman | 208/252 |
| 4,778,590 | 10/1988 | Reynolds | 208/252 |
| 4,778,592 | 10/1988 | Reynolds | 208/252 |
| 4,789,463 | 12/1988 | Reynolds | 208/253 |
| 4,988,433 | 1/1991 | Reynolds | 208/252 |
| 5,078,858 | 1/1992 | Hart et al. | 208/252 |
| 5,282,959 | 2/1994 | Roling et al. | 208/252 |

*Primary Examiner*—Helane Myers
*Attorney, Agent, or Firm*—D. W. Eggins

[57] ABSTRACT

Metals are removed from used, contaminated oils, such as crankcase oils from cars, by a low temperature, batch tank process. The oil is hydrated by adding enough water to prevent premature crystallization of a reagent salt from solution in a succeeding stage of the process. The batch is heated to a low, required reaction temperature. A quantity of a primary demetalizing agent, comprising an ammonium based salt, or its requisite acid and base to from the salt in-situ, is added in the range of stoichiometric to multiples of stoichiometric, in accordance with the analysed quantum of metals present in the oil batch. The mixture is stirred to react the metals present with the salt, and is then cooled, to precipitate the thus formed sludge, which is then physically separated. The residual oil is reheated, rehydrated if necessary, and a secondary sequestering agent is added, comprising a metal complexing agent selected from the group comprising water soluble salts of ethylenediamine-tetraacetic acid (EDTA), n-hexylamine, ethylenediamine, water-soluble salts of tartaric acid, and alkylbenzene-sulfonic acids, and compatible mixtures thereof, to complex any remaining metallic compounds, for removal as sludge and crystals.

14 Claims, No Drawings

OIL DEMETALIZING PROCESS

FIELD OF INVENTION

The present invention is directed to an oil demetalizing process, and to demetalized oil produced by the process.

BACKGROUND TO THE INVENTION

The recent development of a higher regard for ecological survival has collided with earlier uses made of metal-contaminated waste oils.

Vast quantities of metal contaminated lubricating oils are generated by the operation of automobiles. Other sources of metal contaminated oils also exist.

These contaminated oils have been fairly widely used in the past as fuels, and as dust suppression agents, in road oiling. However, recent environmental legislation has imposed standards for maximum metal content in such oils that may not be readily, economically met by existing processes.

In addition to achieving adequate oil demetalization it is also highly desireable that the by-products of any such demetalization process shall also be reasonably amenable to disposal by being of minimal solubility and minimal volume, and able to meet environmental concerns and regulations.

A further concern to be addressed, both from an economic and ecological standpoint, is the need to minimize thermally induced air polution, by the avoidance of high process temperatures; and from the standpoint of safety, to avoid high operating pressures for the process.

The following United States Patents bear upon prior art methods for oil treatment:

U.S. Pat. No. 3,305,478 teaches the use of oil-soluble amines as floculating agents (in amounts far exceeding the total metal concentrations). However, these cannot meet required modern standards, particularly in regard to lead content. U.S. Pat. No. 3,639,229 teaches the use of large volumes of aliphatic alcohols as a sludge pretreatment, prior to conventional refining. Specific metal levels are not given, while suitability for use in dust suppression and combustion of the end-product are not dealt with.

U.S. Pat. No. 3,763,036 teaches the use of large quantities of methyl ethyl ketone (in excess of the oil being treated), at low temperatures, for the reduction of lead content in waste lube oils. However, the residual lead levels far exceed (at ratios ranging from 25:1 to 50:1) the values presently acceptable for use as fuels and dust suppressants.

U.S. Pat. No. 3,879,282 teaches the use of aqueous solutions of ammonium dihydrogen phosphate and/or diammonium hydrogen phosphate to remove most metals, including lead. However, the residual lead levels far exceed the presently permissible lead levels for fuels and dust suppressants, unless the process employs high temperatures and pressures; or unless silica jel or similar adsorbents are used to remove compounds such as tetraethyllead, lead oxides and lead chloride that do not react with the ammonium phosphates.

U.S. Pat. No. 3,930,988 teaches the use of solutions of ammonium hydrogen sulfate and/or diammonium sulfate in the manner of '282, above.

U.S. Pat. No. 3,985,642 teaches the use of (preferably anionic) surfactants and amines in combination, for reclaiming spent or used lubrication oils, for re-use as such. In certain cases elevated pressures are required for the method to operate successfully. The re-use of the product as a fuel or as dust suppressant materials is not dealt with.

U.S. Pat. No. 4,073,720, while teaching an overall reclamation method applicable to waste lubricating oils that achieves levels of metallic reduction that meet the desired standards for fuel or dust suppression use, does so by the use of vacuum distillation at very high temperatures, to remove water and volatile materials before the oil is cooled and subjected to contact with a solvent mixture to extract the undesired metallic impurities. The amount of solvent mixture required exceeds the amount of oil being processed.

U.S. Pat. No. 4,151,072 is an extension of the teachings of '282 and '988, above. The teaching includes the production of an intermediate oil product demetalized by the application of various ammonium salts and mixtures thereof, followed by thermal agglomeration, drying and filtering of the oil. This is accomplished in a high pressure, high temperature flow system; but does not achieve the standards of metallic reduction presently required, particularly in regard to lead and copper, which do not react with the listed reagents.

U.S. Pat. No. 5,445,945 teaches the use of chelating agents with water/oil emulsions used in metalworking. A chelating agent, EDTA and its salts, is used to diminish the presence of a deleterious microbe by sequestration of metallic ions of iron, nickel, chromium, cobalt, cadmium and copper that originate from machined swarf, and upon which ions the microbes feed. In addition to the forgoing listed patents, the publication Ind.Eng.Chem.Res. 1988, 27, 1222–1228 provides bibliographical references and general background information related to solvent extraction and flocculation technologies for use in the re-refining of lubricating oils.

SUMMARY OF THE INVENTION

The present invention provides the method of treating a metal-contaminated oil to diminish the metallic contamination thereof to meet a predetermined polution standard; including the steps of: heating the hydrated oil to a predetermined low reaction temperature; mixing a predetermined quantity of a primary demetallizing agent with the oil; cooling the mixture to settle out a sludge incorporating at least a portion of the metallic contamination, and separating substantially all the sludge from the mixture; re-heating the hydrated mixture; adding a complexing agent thereto to solvate metallic residues suspended in the mixture; "drying" the mixture by removing a sufficient quantity of water to produce crystallization of the metallic salts into a second sludge; and removing substantially all the sludge present in the oil, to thereby meet the predetermined polution standard. The aforesaid complexing agent may possibly be added by way of its precursors.

In the preferred method, the primary demetallizing agent is added in an amount in excess of stoichiometric, such as up to multiples greater than stoichiometric; e.g. as much as 2.5 times greater.

The quantum of all metals contained in the contaminated feed oil is preferably determined by preliminary analysis.

The ongoing operation of the process may then be based upon typical prior analyses, and the required quantity of primary demetalizing agent calculated that is necessary to provide stoichiometric or a desired excess thereof for all the metal content present therein. Approximations as to the quantity of primary agent required may be based upon experience.

The amount of the primary demetalizing salt lies in the range of 0.8 to 2.5 times the stoichiometric amount required to react with all the metal present in the batch. The preferred value is 1.5 times stoichiometric.

The preliminary extent of hydration of the oil may be determined, and the water content thereof increased to the point that the selected quantity of the primary demetallizing agent will not crystallize out of the mix that it forms with the contaminated, hydrated oil.

In the case of the preferred ammonium salt a preliminary water content of about 10% by volume achieves the desired reaction, without the reagent crystallizing out prematurely, or without the formation of a thick emulsion that resists filtration, which may arise with either too little or too much water.

The primary demetalizing agent is water soluble and is selected from the group comprising: ammonium dihydrogen phosphate, diammonium hydrogen phosphate, diammonium sulfate, ammonium hydrogen sulfate, and compatible combinations thereof. The use of the precursors thereof comprising an ammonium salt and sulfuric acid, and an ammonium salt and phosphoric acid; or combinations thereof is contemplated.

The predetermined polution standard, which may vary from one jurisdiction to another, may typically comprise:

ZINC<20 ppm

CHROMIUM<3 ppm

COPPER<5 ppm

BARIUM<5 ppm

LEAD<3 ppm

The step of hydrating or controlling the hydration of the metal-contaminated oil, which is preferably batch-treated in a mixing tank, may be by simple addition of water, or by use of a condenser, or by the operation of a reflux system.

The degree of hydration is such that the relatively saturated primary demetalizing agent will NOT crystalize out during the primary reaction.

The primary reaction, is a low temperature reaction, in the range of about 50 degrees Celsius (50° C.) to the flashpoint of the oil, (i.e. about 125° C.) and preferably in about the mid-range of 80° to 100° C. The low re-heat temperature for the second, complexing step of the process is in the preferred range of 80° to 100° C. However, a range in the order of ambient to the flash point of the oil is feasible for at least some of the secondary sequestering (complexing) agents.

The steps of the process are carried out at low pressure; i.e. substantially atmospheric, primarily on grounds both of safety and of cost.

The raw polluted oil feed stock is not normally subject to preliminary filtration or stripping of water (i.e. no "drying") During the primary demetallization reaction, the mixture is stirred for a sufficient length of time to effect substantial removal of the metal from solution. While the reaction time can vary as much as from 0.5 to 24 hours, a normal reaction time is in the order of 4.5 hours.

The stirring is then stopped, and the mixture is allowed to cool to the extent, usually ambient temperature, for the metal salts to settle out as a sludge, which is then removed. Sludge removal is mechanical, and may be by filtration, centrifugation or by pumping off the oil.

The sludge by-product may be dried if necessary, and binding agents such as calcium oxide may be added. However, the sludge is generally acceptable as a non-hazardous waste, for disposal in landfill sites.

Upon completion of the primary stripping portion of the process the residual oil product is dramatically depleted of most metals. However, unacceptably high levels of lead and copper usually remain.

The second, complexation step of the process may require rehydrating of the oil, which is reheated to a relatively low temperature, preferably about mid-point in the range of 80° to 100° C.

The complexing agent for effecting the second step of the process is selected from the group consisting of the water soluble salts of ethylenediaminetetraacetic acid (EDTA), n-hexylamine, ethylenediamine, water suluble salts of tartaric acid and alkylbenzene-sulfonic acid and combinations thereof. After sufficient time lapse to effect complexation, in which the generally water-soluble stable complexes thus formed are suspended in solution, the mixture is dehydrated, usually by raising the temperature thereof to evaporate most of the water. At this stage the contaminants are primarily in the form of crystals and sludge, and these remaining traces of sludges and metal-containing crystals are then removed, preferably mechanically by settling, filtration, centrifugation, etc., to leave a clarified, dark red oil product.

The specific ranges that have been used in practice in the primary stripping reaction generally rely upon a high salt concentration solution, of saturated or nearly saturated solution.

The preferred salts are diammonium phosphate or ammonium hydrogen sulphate. These salts are preferably used alone. However, the use of a mixture thereof is contemplated.

The secondary reaction generally uses the sequestering agent as a saturated or nearly saturated solution. The preferred choice is a saturated solution of the disodium salt of EDTA, reacted at 80 degrees C.

The present invention further provides a refurbished oil having a majority of metal contaminants removed therefrom by way of the foregoing process.

The subject refurbished oil is characterized by a substantial absence of a quantum of metals, and by its clarity and clear dark red colour.

The subject process has been carried out for some differing samples of contaminated oils, as follows:

EXAMPLE 1

Carried out in a batching, mixing tank, at atmospheric pressure .

A relatively "dirty" used lubricating oil (i.e. analysed to have about four times the amount of lead normally found in 1995 in automotive waste oil) was reacted with 1.5 stoichiometric equivalents of saturated ammonium hydrogen sulfate solution, for 4.5-hours at 90° C.

The starting emulsified water content was approximately 10% by volume.

After the primary reaction was carried out and the mixture was cooled, the oil was decanted.

The secondary reaction was then carried out, using 0.5 wt. % disodium EDTA, dissolved in sufficient water to provide a saturated solution. The reaction was carried out at 90° C. for 1.0 hour.

The mixture was then heated to about 110° C., for a time sufficient to drive off most of the water, and the resultant oil was vacuum filtered through a 1-micron pore-size perlite bed.

| METAL | CONCENTRATION (ppm) Before Treatment | After Treatment |
|---|---|---|
| Zinc | 566 | 4 |
| Chromium | 1 | <1 |
| Cadmium | <1 | <1 |
| Copper | 69 | 3 |
| Barium | 11 | 5 |
| Iron | 210 | 10 |
| Lead | 201 | 2 |

EXAMPLE 2

This was carried out under the same conditions as for Example 1, and using as primary demetalizing agent diammonium phosphate.

| METAL | CONCENTRATION (ppm) Before Treatment | After Treatment |
|---|---|---|
| Zinc | 519 | 4 |
| Chromium | 3 | <1 |
| Cadmium | 3 | <1 |
| Copper | 67 | 10 |
| Barium | 11 | <1 |
| Iron | 171 | 4 |
| Lead | 180 | 4 |

EXAMPLE 3

In this treatment a more typical, less contaminated motor oil was used, using the primary and secondary reactants of Example 1, under substantially the same conditions and stoichiometric ratios.

| METAL | CONCENTRATION (ppm) Before Treatment | After Treatment |
|---|---|---|
| Zinc | 1193 | 10 |
| Chromium | <1 | <1 |
| Cadmium | <1 | <1 |
| Copper | 3 | <1 |
| Barium | <1 | <1 |
| Iron | 178 | 14 |
| Lead | 18 | 4 |

Comparison of Test Results

| METAL | CONCENTRATION (ppm) Feed Oil | Filter Only | Primary Only | Seq Agt Only |
|---|---|---|---|---|
| Zinc | 519 | 692 | 18 | 133 |
| Chromium | 3 | 1 | <1 | <1 |
| Cadmium | 3 | 2 | <1 | <1 |
| Copper | 67 | 67 | 19 | 18 |
| Barium | 11 | 12 | 9 | 11 |
| Iron | 171 | 178 | 57 | 116 |
| Lead | 180 | 184 | 13 | 50 |

Conclusions

The above described batch process operates at atmospheric pressure, and a+ moderate temperatures, for enhanced safety considerations, and minimal generation of atmospheric contamination.

Lead levels in particular, and those of other metals are reduced to ecologically acceptable levels.

The adoption of a two-step process, with an intermediate removal step after carrying out the primary demetallizing step substantially eliminates re-dissolution of some metals that would otherwise occur if the completing agent were merely added after the primary reaction.

The EDTA sequestering agent used in the preferred embodiment does not leave objectionable toxic residues in the final product, thereby qualifying the de-metalized oil for use as a dust suppressant product, or for use as a fuel.

What is claimed by Letters Patent of the United States is:

1. The method of treating a metals-contaminated oil mixture to diminish the metallic content thereof to meet a stipulated polution standard defining maximum allowable concentrations of specified toxic metals including lead and copper, comprising the steps of: hydrating a quantity of said mixture to a first level of hydration; heating the hydrated oil to a first low temperature below the flashpoint of the oil, and effective for a desired first demetalizing reaction; mixing a primary demetalizing agent in a quantity of at least about stoichiometric, based upon the concentration of contaminating metals, in said oil to effect said first demetalizing reaction; said first level of hydration being sufficient to enable said first demetalizing reaction to proceed without premature crystalization of said primary agent from said mixture; cooling the mixture to settle out sludge incorporating at least a portion of said metallic content of said metals-contaminated oil mixture, to diminish the metallic contamination of the mixture; separating substantially all said sludge from the mixture; re-heating the remaining mixture to a second low temperature below the flashpoint of the oil; adding a water-soluble complexing agent thereto to solvate metallic residues, including residues of lead and copper, suspended in the mixture as metal chelates; reducing the hydration level of the reheated mixture to crystalize substantially all said metal chelates, including chelates of said lead and copper as precipitated components; and removing substantially all the sludge and precipitated components present in the oil, to thereby substantially deplete said oil of metal contaminants including said chelates of lead and copper, to meet said stipulated polution standard.

2. The method as set forth in claim 1, said step of hydrating said quantity of said oil mixture to said first level of hydration comprising adding water to said contaminated oil, to achieve said first level of hydration.

3. The method as set forth in claim 1, the reduction of said hydration level comprising removing substantially all the water from said re-heated mixture.

4. The method as set forth in claim 3, wherein said water is removed by heating.

5. The method as set forth in claim 1, wherein said stipulated polution standard comprises:

Zinc<20 ppm

Chromium<3 ppm

Cadmium<1 ppm

Copper <5 ppm

Barium<5 ppm

Lead<3 ppm.

6. The method as set forth in claim 1, wherein said metals contaminated oil mixture is analyzed to determine the total quantity of undesired metals present in a batch of oil being treated, the quantity of primary demetalizing agent being calculated in relation thereto to determine a value for achieving a stoichiometric mixture therewith; and adding a quantity of said primary agent to said hydrated batch in predetermined relation to said stoichiometric value.

7. The method as set forth in claim 1, said primary demetalizing agent being selected from the group consisting of: ammonium dihydrogen phosphate, diammonium hydrogen phosphate, diammonium sulfate, ammonium hydrogen sulfate, and compatible combinations thereof.

8. The method as set forth in claim 1, said primary demetalizing agent being selected from the group consisting of precursor materials comprising an ammonium salt and sulfuric acid, and an ammonium salt and phosphoric acid, and combinations thereof.

9. The method as set forth in claim 1, said complexing agent being selected from the group consisting of water-soluble salts of ethylenediaminetetraacetic acid (EDTA);

n-hexylamine; ethylenediamine; tartaric acid salts;

alkylbenzene sulfonic acid, and compatible combinations thereof.

10. The method as set forth in claim 1, said water-soluble complexing agent being selected from the group consisting of ethylenediamine tetraacetic acid (EDTA) salts, n-hexylamine, ethylenediamine, tartaric acid salts and alkylbenzene-sulfonic acid and combinations thereof.

11. The method as set forth in claim 10, said complexing agent being added in an amount to solvate substantially all metallic residues suspended in said reheated mixture.

12. The method as set forth in claim 7, said primary demetalizing agent being diammonium phosphate.

13. The method as set forth in claim 7, said primary demetalizing agent being ammonium hydrogen sulfate.

14. The method as set forth in claim 10, said water-soluble complexing agent comprising a saturated solution of the disodium salt of EDTA; said mixture being at about substantially 80° C.

* * * * *